US006457448B1

(12) United States Patent
Dietz

(10) Patent No.: US 6,457,448 B1
(45) Date of Patent: Oct. 1, 2002

(54) DEVICE FOR VARYING THE CONTROL TIMES OF GAS EXCHANGE VALVES OF AN INTERNAL COMBUSTION ENGINE

(75) Inventor: Joachim Dietz, Frensdorf (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 10/048,809

(22) PCT Filed: Jul. 13, 2000

(86) PCT No.: PCT/EP00/06665

§ 371 (c)(1),
(2), (4) Date: Jan. 29, 2002

(87) PCT Pub. No.: WO01/11203

PCT Pub. Date: Feb. 15, 2001

(30) Foreign Application Priority Data

Aug. 5, 1999 (DE) ..... 199 36 921

(51) Int. Cl.[7] ..... F01L 1/344
(52) U.S. Cl. ..... 123/90.17; 123/90.37
(58) Field of Search ..... 123/90.15, 90.17, 123/90.31, 90.37

(56) References Cited

U.S. PATENT DOCUMENTS

| | | | | |
|---|---|---|---|---|
| 5,813,378 | A * | 9/1998 | Sato | 123/90.17 |
| 6,170,447 | B1 * | 1/2001 | Kohrs et al. | 123/90.17 |
| 6,267,089 | B1 * | 7/2001 | Golovatai-Schmidt | 123/90.17 |
| 6,289,862 | B1 * | 9/2001 | Schafer et al. | 123/90.17 |
| 6,374,785 | B1 * | 4/2002 | Schafer et al. | 123/90.15 |

FOREIGN PATENT DOCUMENTS

| | | |
|---|---|---|
| DE | 19825288 | 12/1998 |
| DE | 19745908 | 4/1999 |
| EP | 0807746 | 11/1997 |
| EP | 0818610 | 1/1998 |
| JP | 10089021 | 4/1998 |
| JP | 10184322 | 7/1998 |

* cited by examiner

*Primary Examiner*—Weilun Lo
(74) *Attorney, Agent, or Firm*—Bierman, Muserlian and Lucas

(57) ABSTRACT

A hydraulic camshaft adjusting device in a rotary piston design, which comprises a drive wheel (2) that is drive-connected to a crankshaft and an impeller wheel (10) connected in a rotationally fixed manner to a camshaft (9), the drive wheel (2) comprising a cavity formed by a peripheral wall (3) and two lateral walls (4, 5), in which cavity at least one hydraulic working space is formed by at least two delimitation walls (7), the impeller wheel (10) has at least one radial blade (13), and with each blade (13) divides a hydraulic working space into two hydraulic pressure chambers, each blade (13) of the impeller wheel (10) is pressed by a spring element (17), by its upper end surface (8) against the peripheral wall (3) of the drive wheel (2) wherein each blade (13) of the impeller wheel (10) can additionally be pressed radially by the compressive force of the hydraulic pressure medium that can be selectively applied to its lower end surface (16), by its upper end surface (18) against the peripheral wall (3) of the drive wheel (2), the latter comprising, on one or both of its lateral surface(s), at least one additional pressure-medium channel (21) starting from its lower end surface (16).

4 Claims, 3 Drawing Sheets

C - C

DEVICE FOR VARYING THE CONTROL TIMES OF GAS EXCHANGE VALVES OF AN INTERNAL COMBUSTION ENGINE

FIELD OF THE INVENTION

The invention relates to a device for varying the control times of gas exchange valves of an internal combustion engine and is particularly advantageously implementable on hydraulic camshaft adjusting devices in a rotary piston design.

BACKGROUND OF THE INVENTION

Such a device was generically disclosed by EP 0 818 610 A2. This device, configured as what is known as a vane cell adjusting device, comprises first a drive wheel configured as an outer rotor and drive-connected to a crankshaft of the internal combustion engine, which drive wheel comprises a cavity formed by a hollow cylindrical peripheral wall and two lateral walls. Within this cavity five hydraulic working spaces are formed by five delimitation walls starting from the inside of the peripheral wall and oriented toward the longitudinal central axis of the drive wheel. The device further comprises an impeller wheel configured as an inner rotor, connected in a rotationally fixed manner to a camshaft of the internal combustion engine and inset into the cavity of the drive wheel. On the periphery of its wheel hub, the impeller wheel in turn has five blades, each disposed in an axial retaining groove, which each extend radially into a hydraulic working space of the drive wheel and divide the latter into pairs of hydraulic pressure chambers working in opposition to one another. Each blade of the impeller wheel is pressed radially, by the force of a spring element on its lower end surface in the axial retaining groove, by its upper end surface against the inside of the peripheral wall of the drive wheel. As a result, the pressure chambers of each hydraulic working space are sealed off from one another and, when selectively or simultaneously subjected to the action of pressure by means of a hydraulic pressure medium, effect a pivot movement or fixing of the impeller wheel relative to the drive wheel and hence of the camshaft relative to the crankshaft.

It is a disadvantage of this known device that when one or both pressure chamber(s) of each hydraulic working space are subjected to the action of pressure, a pressure build-up also takes place in the sealing gap between the upper end surface of each blade and the inside of the peripheral wall of the drive wheel. If the compressive force here exceeds the value of the spring force of the spring element disposed at the lower end surface of each blade, then, despite these spring elements, what is known as "blade dipping" may occur, meaning a radial displacement of the blades against the force of their spring elements. This in turn causes increased pressure medium leakages between the individual pressure chambers of the hydraulic working spaces, so that inferior hydraulic tensioning of the impeller wheel relative to the drive wheel occurs. In addition, these increased pressure medium leakages can be the cause of major deviations from the predetermined angle of adjustment between camshaft and crankshaft and of longer periods for the adjustment of the device.

OBJECT OF THE INVENTION

It is therefore an object of the invention to design a device for varying the control times of gas exchange valves of an internal combustion engine, especially a hydraulic camshaft adjusting device in a rotary piston design, in which the radial displacement of the blades against the force of their spring elements arising from the pressure build-up in the sealing gap between the upper end surface of each blade of the impeller wheel and the inside of the peripheral wall of the drive wheel is effectively prevented.

SUMMARY OF THE INVENTION according to the invention, this object is achieved with a device in accordance with the present invention, in that when one or both pressure chamber(s) of each hydraulic working space of the device are subjected to the action of pressure, each blade of the impeller wheel, in addition to the force of its spring element, can be pressed radially by the compressive force of the hydraulic pressure medium that can be selectively applied to its lower end surface, by its upper end surface against the inside of the peripheral wall of the drive wheel.

In an expedient further development of the invention, the entire lower end surface of each blade of the impeller wheel is simultaneously configured as its pressure impact surface, acting in the radial direction to the peripheral wall of the drive wheel, for the hydraulic pressure medium. In addition, each blade comprises, on one or both of its lateral surface(s), at least one additional pressure-medium channel starting from its lower end surface, which is directly or indirectly hydraulically connected to at least one of the pressure chambers adjoining the respective blade.

In a further embodiment of the invention, this additional pressure-medium channel on one or both lateral surface(s) of each blade is, depending on the embodiment, preferably disposed on or close to the longitudinal central axis of each blade, in order to achieve a uniform pressure build-up at its pressure impact surface and prevent axial tilting of the blade in its retaining groove. The direct or indirect hydraulic connection to at least one of the pressure chambers of the device adjoining the respective blade is, by contrast, achieved by a variable length of the additional pressure-medium channel, in that the latter optionally ends above or below or precisely at the height of the peripheral surface of the wheel hub of the impeller wheel. As a result, the pressure-medium pressure acting on the pressure impact surface of the blade can be set so that, with decreasing length of the additional pressure-medium channel toward the pressure impact surface of the blade, the pressure-medium pressure building up at the pressure impact surface can be reduced. This means that, with an additional pressure-medium channel of a length ending above or precisely at the height of the peripheral surface of the wheel hub of the impeller wheel, the pressure-medium pressure in the pressure chamber directly connected to the pressure-medium channel also prevails at the pressure impact surface of the blade. However, the further the additional pressure-medium channel ends below the height of the peripheral surface of the wheel hub of the impeller wheel, the lower becomes the pressure-medium pressure at the pressure impact surface of the blade, throttled by the gap between the lateral surface of the blade and the groove wall of the retaining groove of the blade.

In a particularly advantageous first embodiment of the additional pressure-medium channel on one or both lateral surfaces of each blade, the latter is preferably configured as a radial groove machined into the lower end surface of the blade and continuous from one lateral surface to the other lateral surface of the blade. This radial groove has a length ending below the peripheral surface of the wheel hub of the impeller wheel and is thus indirectly hydraulically connected to both of the pressure chambers of the device adjoining the blade. In addition, the radial groove preferably has a width approximately corresponding to the thickness of the blade and is directly machined into the blade along the longitudinal central axis thereof. However, the width of the radial groove and/or its arrangement relative to the longitudinal central axis of the blade may also be variably configured. The pressure medium leakages possible with an additional pressure-medium channel configured in this way between the two pressure chambers of the device adjoining each blade are prevented, at least when only one pressure chamber of each of the hydraulic working spaces is subjected to the action of pressure, in that the blades, as a result of the unilateral action of pressure, perform a slight tilting movement within their axial retaining grooves toward whichever chamber is not subjected to the action of pressure. As a result of the linear contact between their lateral surfaces limiting the pressure chambers not subject to the action of pressure and the edge at which their axial retaining grooves make the transition to the peripheral surface to the wheel hub of the impeller wheel, the blades then automatically form a gap seal relative to the pressure chambers not subjected to the action of pressure, whereby the passage of the hydraulic pressure medium from one pressure chamber to the other is prevented. It is also possible, however, to configure the additional pressure-medium channel on each blade, configured as a radial groove, with a length ending precisely on or above the peripheral surface of the wheel hub of the impeller wheel and thus to connect it hydraulically to both pressure chambers of the device adjoining each blade. As a result, the pressure build-up on the pressure impact surface of the blade can advantageously be accelerated, but the increased pressure medium leakages thereby arising between the two pressure chambers and the reduced pressure-medium pressure resulting must be taken into account.

In an equally advantageous second embodiment of the additional pressure-medium channel on one or both lateral surfaces of each blade, the latter is preferably configured as two part-channels each machined into a lateral surface of the blade and formed as a radial indentation or basic groove in the blade. Each of these part-channels also has a length preferably ending below the peripheral surface of the wheel hub of the impeller wheel and is thus indirectly hydraulically connected to both of the pressure chambers of the device adjoining the blade. In addition, the part-channels, as in the first embodiment of the additional pressure-medium channel, preferably have a width approximately corresponding to the thickness of the blade us are machined, to a depth corresponding to approximately one third of the thickness of the blade, into the lateral surfaces of the blade along the longitudinal central axis thereof. Instead of a part-channel in each lateral surface of the blade having such a width, however, it is also possible to divide each part-channel into two or more narrower channel arms, which are disposed parallel to one another and symmetrically relative to the longitudinal central axis of the blade on each lateral surface of the blade. Similarly, for example if the disadvantageous radial displacement of the blades on the impeller wheel is to be prevented only if one pressure chamber of the device is subjected to the action of pressure, it may be of advantage to machine one or several of these part-channels or channel arms into only one lateral surface of each blade. Irrespective thereof, the pressure medium leakages possible with such an additional pressure-medium channel between the two pressure chambers of the device adjoining each blade are again prevented, as in the first embodiment, as a result of the linear contact arising in the event of a unilateral action of pressure between the lateral surfaces of the blades and the edge at which their axial retaining grooves make the transition to the peripheral surface to the wheel hub of the impeller wheel. In addition, in this embodiment also, for accelerated build-up of pressure at the pressure impact surface of each blade, it is possible to configure the additional pressure-medium channel, subdivided into part-channels or alternatively into channel arms and having a length ending precisely on or above the peripheral surface of the wheel hub of the impeller wheel and thus to connect it hydraulically directly to both pressure chambers of the device adjoining each blade, though here again the increased pressure medium leakages between the two pressure chambers must be taken into account.

The device configured according to the invention for varying the control times of gas exchange valves of an internal combustion engine, especially a hydraulic camshaft adjusting device in a rotary piston design, thus comprises, by comparison with the devices known from the prior art, the advantage that when one or both pressure chamber(s) of each hydraulic working space of the device are subjected to the action of pressure, what is known as "blade dipping", in other words the radial displacement of the blades against the force of their spring elements resulting from the pressure build-up in the sealing gap between the upper end surface of each blade of the impeller wheel and the inside of the peripheral wall of the drive wheel is effectively prevented. This is achieved, according to the invention, by the selective application of the compressive force of the hydraulic pressure medium to the lower end surface, configured as a pressure impact surface, of each blade, so that in addition to the force of their spring elements the blades can be pressed radially by their upper end surfaces against the inside of the peripheral wall of the drive wheel. As this merely requires an additional pressure-medium channel on one or both lateral surface(s) of each blade, starting from its lower end surface, cost-effective production of the device configured according to the invention may be claimed as a further advantage thereof.

BRIEF DESCRIPTION OF THE DRAWINGS

The invention will be described below with reference to an example of embodiment. In the appended drawings.

DETAILED DESCRIPTION OF THE DRAWINGS

Figure 1:
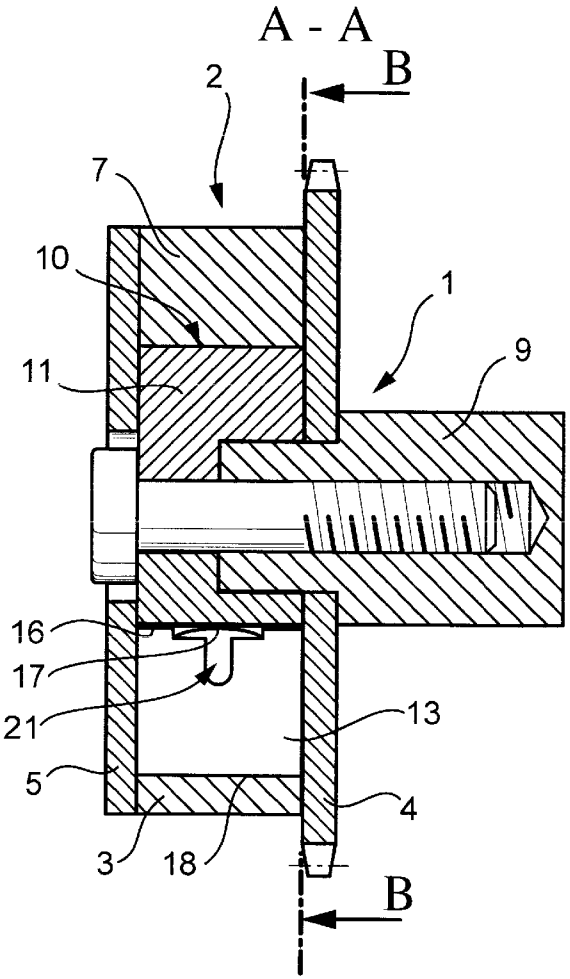
FIG. 1 shows the longitudinal section A—A indicated in FIG. 2 through a device configured according to the invention.
Figure 2:
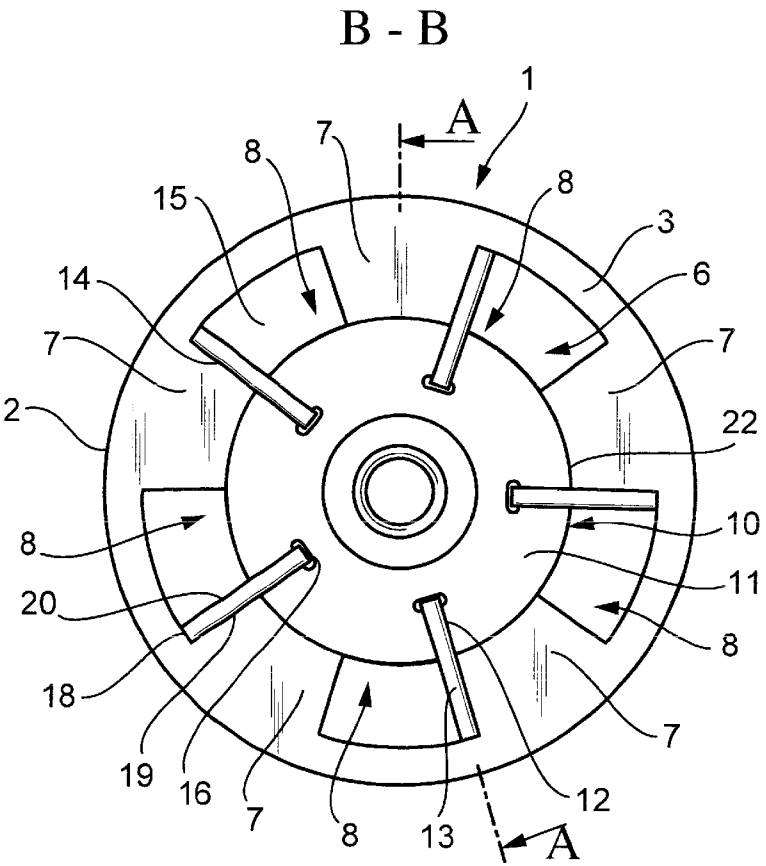
FIG. 2 shows the cross section B—B indicated in FIG. 1 through a device configured according to the invention.

FIGS. 1 and 2 clearly show a device 1, configured as a hydraulic camshaft adjusting device in the rotary piston design, for varying the control times of gas exchange valves of an internal combustion engine, which comprises a drive wheel 2 configured as an outer rotor and drive-connected to a crankshaft (not shown) of the internal combustion engine and of an impeller wheel 10 configured as an inner rotor and connected in a rotationally fixed manner to a camshaft 9 of the internal combustion engine. The drive wheel 2 comprises a cavity 6 formed by a peripheral wall 3 and two lateral walls 4,5 within which cavity five hydraulic working spaces 8 are formed by five delimitation walls 7 starting from the inside of the peripheral wall 3 and oriented toward the longitudinal central axis of the drive wheel 2. It is also apparent from FIGS. 1 and 2 that the impeller wheel 10 likewise comprises on the periphery of its wheel hub 11 five blades 13 each disposed in an axial retaining groove 12 and is inserted into the cavity 6 of the drive wheel 2 in such a manner that each blade 13 extends radially into a working space 8 of the drive wheel 2 and divides the latter into pairs of hydraulic pressure chambers 14, 15 working in opposition to one another. Clearly visibly here, each blade 13 of the impeller wheel 10 is pressed radially, by the force of a spring element 17 on its lower end surface 16 in the axial retaining groove 12, by its upper end surface 18 against the inside of the peripheral wall 3 of the drive wheel 2 so that the pressure chambers 14, 15 are sealed off from one another and, when selectively or simultaneously subjected to the action of pressure by means of a hydraulic pressure medium, effect a pivot movement or fixing of the impeller wheel 10 relative to the drive wheel 2 and hence of the camshaft 9 relative to the crankshaft.

In order to prevent "blade dipping" resulting from the pressure build-up in the sealing gap between the upper end surface 18 of each blade 13 of the impeller wheel and the inside of the peripheral wall 3 when one or both pressure chamber(s) 14, 15 of each hydraulic working space 8 of the device are subjected to the action of pressure, according to the invention, each blade 13 of the impeller wheel 10, in addition to the force of its spring element 17, can be pressed radially by its upper end surface 18 against the inside of the peripheral wall 3 of the drive wheel 2 by the selective application of the compressive force of the hydraulic pressure medium to its lower end surface 16. It is apparent here from FIG. 1 that, for this purpose, the entire lower end surface 16 of each blade 13 of the impeller wheel 10 is simultaneously configured as its pressure impact surface, acting in the radial direction, for the hydraulic pressure medium and each blade 13 comprises, on one or both of its lateral surface(s) 19, 20, at least one additional pressure-medium channel 21 starting from its lower end surface 16, which is directly or indirectly hydraulically connected to at least one of the pressure chambers 14, 15 of the device 1 adjoining the respective blade 13.

Figure 3:
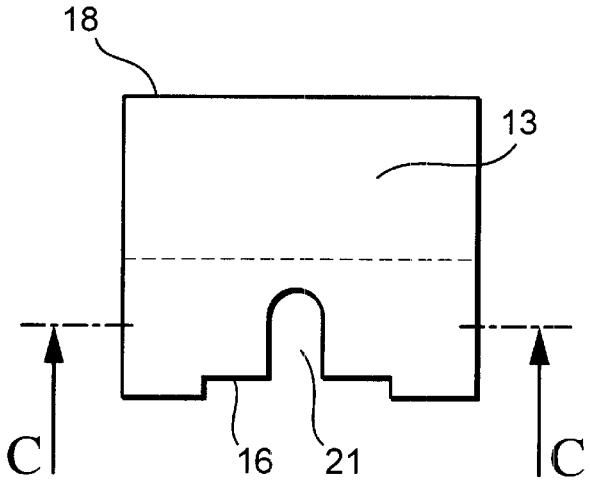
FIG. 3 shows the enlarged front view of a first embodiment of a blade of an impeller wheel.
Figure 4:
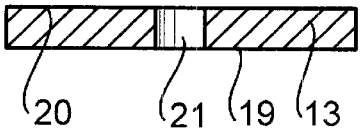
FIG. 4 shows the cross section C—C indicated in FIG. 3 through the first embodiment of a blade of an impeller wheel.
Figure 5:
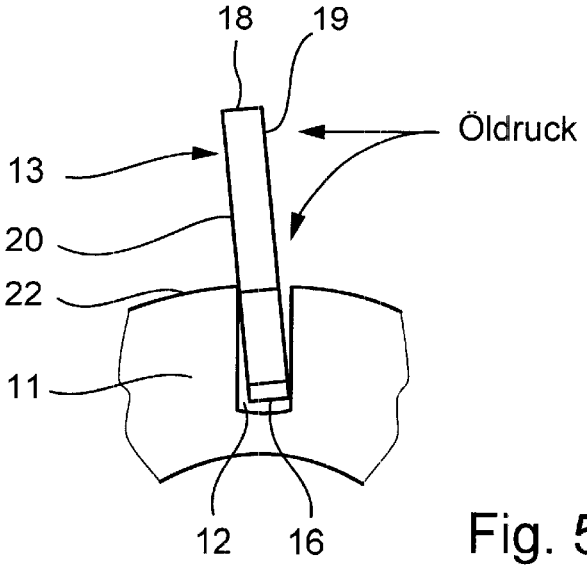
FIG. 5 shows an enlarged partial view of the cross section indicated in FIG. 2 with the first embodiment of a blade of the impeller wheel in the assembly position.

In the first embodiment of the additional pressure-medium channel 21 shown in FIGS. 3 and 4, the latter is configured as a radial groove machined into the lower end surface 16 of the blade 13 along its longitudinal central axis and continuous from one lateral surface 19 to the other lateral surface 20 of the blade 13. This radial groove has a length ending below the peripheral surface 22, indicated as a broken line, of the wheel hub 11 of the impeller wheel 10 and is thus indirectly hydraulically connected to both of the pressure chambers 14, 15 of the device 1 adjoining the blades 13. The highly idealized drawing in FIG. 5 makes it clear that in this case the pressure medium leakages possible with such a radial groove between the two pressure chambers 14, 15 adjoining each blade 13 are prevented, at least when only one pressure chamber 14 or 15 of each of the hydraulic working spaces 8 is subjected to the action of pressure in that the blades 13, as a result of the unilateral action of pressure indicated by arrows, perform a slight tilting movement within their axial retaining grooves 12 and, as a result of the linear contact between their lateral surfaces 20 and the edge at which their axial retaining grooves 12 make the transition to the peripheral surface 22 of the wheel hub 11 of the impeller wheel 10, the blades then automatically form a gap seal.

Figure 6:
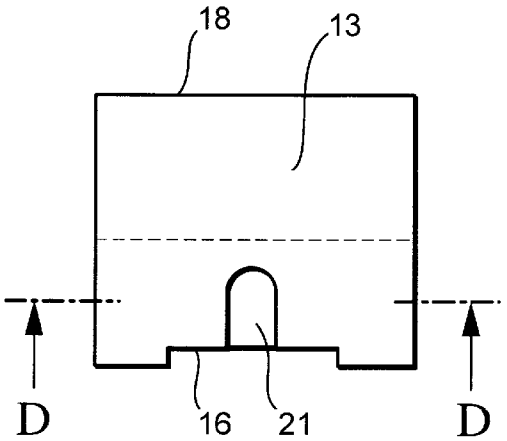
FIG. 6 shows the enlarged front view of a second embodiment of a blade of the impeller wheel.
Figure 8:
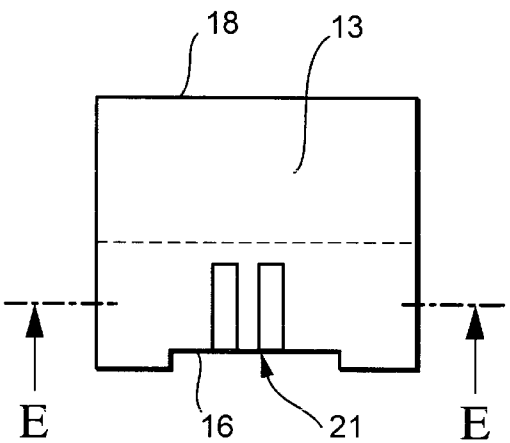
FIG. 8 shows the enlarged front view of an alternative embodiment of the second embodiment of a blade of the impeller wheel.
Figure 7:
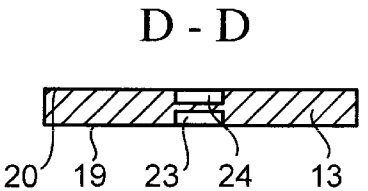
FIG. 7 shows two possible variations of the cross section D—D indicated in FIG. 6 through the second embodiment of a blade of the impeller wheel.
Figure 7:
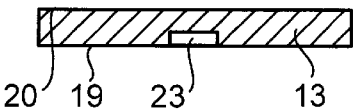
Figure 9:
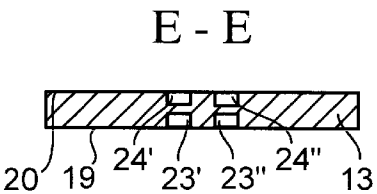
FIG. 9 shows the cross section E—E indicated in FIG. 8 through two possible variations of the alternative embodiment of the second embodiment of a blade of the impeller wheel.
Figure 9:
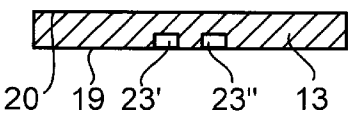

In the second embodiment of the additional pressure-medium channel 21 shown in FIGS. 6 and 7, by contrast, the latter is configured as two part-channels 23, 24, which are machined opposite one another and again along the longitudinal central axis into, in each case, one lateral surface 19, 20 of the blade 13 and formed as a radial indentation or basic groove. As in the case of the first embodiment, the part-channels 23, 24 also have a length ending below the peripheral surface 22, indicated by a broken line, of the wheel hub 11 of the impeller wheel 10, so that the part-channel 23 is indirectly hydraulically connected to one pressure chambers 14 adjoining the blade 13 and the part-channel 24 to the other pressure chambers 15 adjoining the blade 13. The lower illustration in FIG. 7 is also intended to indicate that it is also possible to machine only one part-channel 23 into the lateral surface 19 of the blade 13 or, though this is not shown in detail, to machine only one part-channel 24 into the lateral surface 20 of the blade 13. As an alternative to this second embodiment of the additional pressure-medium channel 21, moreover, FIGS. 8 and 9 show that it may also be advantageous to divide each of the part-channels 23, 24 into two channel arms, 23' and 23" in one case and 24' and 24" in the other, these likewise being configured as a radial indentation or basic groove and being machined symmetrically and opposite to one another next to the longitudinal central axis into the lateral surfaces 19, 20 of the blade 13. The lower illustration in FIG. 9, in turn, is merely intended to indicate the possibility of, for example, machining only the two channel arms 23' and 23" into the lateral surface 19 of the blade 13 or machining only the two channel arms 24' and 24", in a manner not shown in detail, into the lateral surface 20 of the blade 13. This additional pressure-medium channel 21 divided into channel arms 23', 23" and 24', 24" likewise ends below the peripheral surface 22, indicated by a broken line, of the wheel hub 11 of the impeller wheel 10, and is thus, in the same manner as in the embodiment shown in FIGS. 6 and 7, indirectly hydraulically connected to the pressure chambers 14, 15 adjoining the blade 13. The pressure medium leakages also possible with a pressure-medium channel 21 divided into part-channels 23, 24 or into channel arms 23', 23" and 24', 24" between the two pressure chambers 14, 15 adjoining each blade 13 are moreover, as in the first embodiment, prevented by the automatic gap sealing of the blades 13, indicated in FIG. 5 and described above, in the event of the unilateral action of pressure.

List of Reference Numerals

1. Device
2. Drive wheel
3. Peripheral wall
4. Lateral wall
5. Lateral wall
6. Cavity
7. Delimitation wall
8. Working space
9. Camshaft

10. Impeller wheel
11. Wheel hub
12. Retaining groove
13. Blade
14. Pressure chamber
15. Pressure chamber
16. Lower end surface
17. Spring element
18. Upper end surface
19. Lateral surface
20. Lateral surface
21. Pressure-medium channel
22. Peripheral surface
23. Part channel
23'. Channel arm
23" Channel arm
24. Part channel
24'. Channel arm
24" Channel arm

What is claimed is:

1. A hydraulic camshaft adjusting device for varying the control times of gas exchange valve of an internal combustion engine, the device including the following features:

the device (1) comprises a drive wheel (2) configures as an outer rotor and drive-connected to a crankshaft of the internal combustion engine, which drive wheel (2) comprises a cavity (6) formed by a hollow cylindrical peripheral wall (3) and two lateral walls (4, 5), within the cavity (6) of the drive wheel (2), at least one hydraulic working space (8) is formed by at least two delimitation walls (7) starting from the inside of the peripheral wall (3) and oriented toward the longitudinal central axis of the drive wheel (2), the device (1) further comprises a impeller wheel (10) configured as an inner rotor and connected in a rotationally fixed manner to a camshaft (9) of the internal combustion engine and inset into the cavity (6) of the drive wheel (2), the impeller wheel (10) has on the periphery of its wheel hub (11) at least one blade (13) disposed in an axial retaining groove (12), which blade (13) extends radially into a working space (8) of the drive wheel (2) and divides the latter into pairs of hydraulic pressure chambers (14, 15) working in opposition to one another, each blade (13) of the impeller wheel (10) is pressed radially, by the force of a spring element (17) on its lower end surface (16) in the axial retaining groove (12), by its upper end surface (18) against the inside of the peripheral wall (3) of the drive wheel (2), the pressure chambers (14, 15), when selectively or simultaneously subjected to the action of pressure by means of a hydraulic pressure medium, effect a pivot movement or fixing of the impeller wheel (10) relative to the drive wheel (2) and hence of the camshaft (9) relative-to the crankshaft, characterized in that when one or both pressure chamber(s) (14, 15) of each hydraulic working space (8) of the device (1) are subjected to the action of pressure, each blade (13) of the impeller wheel (10), in addition to the force of its spring element (17), can be pressed radially by the compressive force of the hydraulic pressure medium that can be selectively applied to its lower end surface (16), by its upper end surface (18) against the inside of the peripheral wall (3) of the drive wheel (2), the entire lower end surface (16) of each blade (13) of the impeller wheel (10) is simultaneously configured as its pressure impact surface, acting in the radial direction, for the hydraulic pressure medium and each blade (13) comprises, on one or both of its lateral surface(s) (19, 20) facing a respective said pressure chamber, at least one additional pressure-medium channel (21) starting from its lower end surface (16), which is directly or indirectly hydraulically connected to at least one of the pressure chambers (14, 15) of the device (1) adjoining the respective blade (13).

2. The device as claimed in claim 1, characterized in that the additional pressure-medium channel (21) on one or both lateral surface(s) (14, 15) of each blade (13) is disposed on or close to a longitudinal central axis of each blade (13) and is directly or indirectly hydraulically connected by a length optionally ending above or below or precisely at the height of the peripheral surface (22) of the wheel hub (11) of the impeller wheel (10) to at least one of the pressure chambers (14, 15) of the device (1) adjoining the blade (13).

3. The device as claimed in claim 2, characterized in that the additional pressure medium channel (21) is configured as a radial groove machined into the lower end surface (16) of the blade (13) and continuous from one lateral surface (19) to the other lateral surface (20) of the blade (13), which has a length ending below the peripheral surface (22) of the wheel hub (11) of the impeller wheel (Lo) and is indirectly hydraulically connected to both of the pressure chambers (14, 15) of the device (1) adjoining the blade (13).

4. The device as claimed in claim 2, characterized in that the additional pressure-medium channel (21) is configured as at least two part-channels (23, 24) each machined into a lateral surface (19, 20) of the blade (13) and formed as a radial indentation or basic groove, which has a length ending below the peripheral surface (22) of the wheel hub (11) of the impeller wheel (10) and is in each case indirectly hydraulically connected to one of the pressure chambers (14, 15) of the device (1) adjoining the blade (13).

* * * * *